US006340233B1

(12) United States Patent
Shieh

(10) Patent No.: US 6,340,233 B1
(45) Date of Patent: Jan. 22, 2002

(54) DECORATIVE TUBE LIGHT WITH MULTIPLE BRANCHES

(76) Inventor: Whiter Shieh, 6F, No. 245, Tun Hua South Road, Sec. 1, Taipei, 106 (TW)

( * ) Notice: Subject to any disclaimer, the term of this patent is extended or adjusted under 35 U.S.C. 154(b) by 0 days.

(21) Appl. No.: 09/553,760

(22) Filed: Apr. 21, 2000

(51) Int. Cl.[7] ..... A45B 3/02; H01R 33/90

(52) U.S. Cl. ..... 362/102; 362/225; 362/252; 135/910; 439/641

(58) Field of Search ..... 362/102, 219, 362/249, 252, 250, 225; 439/641, 650–654; 135/16, 910

(56) References Cited

U.S. PATENT DOCUMENTS 2,414,866 A * 1/1947 Glaser ..... 362/123
2,828,473 A * 3/1958 High ..... 439/323
4,072,857 A * 2/1978 DeVicaris ..... 362/252
4,571,018 A * 2/1986 Annoot ..... 439/281
5,053,931 A * 10/1991 Rushing ..... 362/102
5,323,798 A * 6/1994 Yang ..... 362/102
5,337,225 A * 8/1994 Brookman ..... 362/226
5,502,624 A * 3/1996 Tu ..... 362/102
5,559,681 A * 9/1996 Duarte ..... 362/252
5,733,037 A * 3/1998 Tennis et al. ..... 362/249
5,911,493 A * 6/1999 Walker et al. ..... 362/102

* cited by examiner

*Primary Examiner*—Alan Cariaso
(74) *Attorney, Agent, or Firm*—Troxell Law Office PLLC

(57) ABSTRACT

A decorative tube light string including a power line section, at least one branch member, and a number of extending tube light branches is disclosed. The branch member has an input end removeably connected to one end of the power line section and a plurality of output ends. The branch member is provided with a pair of conductive wires spaced from each other and extending from the input end to each output end. Each of the tube light branches has a first end removeably connected to one of the output ends of the branch member and a second end mounted with an end cap. Each of the tube light branches includes a pair of conductive wires spaced from each other and parallelly extending from the first end to the second end thereof and a plurality of light emitting elements electrically connected between the conductive wires, thereby forming a tube light string with multiple tube light branches. The branch member is further provided with a central through hole adapted to be hanged on a supporting article.

18 Claims, 9 Drawing Sheets

DECORATIVE TUBE LIGHT WITH MULTIPLE BRANCHES

BACKGROUND OF THE INVENTION

1. Field of the Invention

The present invention relates generally to a decorative light string, and more specifically to a decorative tube light incorporating with multiple branches by means of branch members.

2. Description of the Prior Art

A conventional decorative light string usually is composed of a plurality of bulb sockets and an electrical wire. Each of the bulb sockets may receive and hold a light bulb thereon. An electric plug may be provided at one end of the light string for connection with an external power source. This kind of conventional decorative light string does not have water-proof configuration, so that it is not suitable to be used in outdoors.

For this reason, a tube light string typically made of water-proof material and formed with a hollow inner tube therein is developed. The conventional tube light string primarily includes a power line section and a plurality of light strings to become an extending tube light string. A plug is connected to an end of the power line for supplying electric power thereto. Those tube light strings are waterproof, electrically safe and easily to be arranged, so that they are widely used outdoors for decorating especially in festivals.

However, the structure of the both light strings mentioned above are like wires, which are soft and linear figure. So it usually just be simply hung or wound on the trees, doors, windows, or ground. If the conventional light strings are needed to have a branch structure, that can be done by binding the light strings with ropes to form some special branch shape. But it is not easy to bind the light strings in an expected branch shape very well, and the structure of the light strings by binding is not very firm. The light strings are easily sliding or falling off. Besides, it will be very trouble to unwind all the ropes winding on the light strings.

Thus, it is desired to have an improved decorative tube light that can incorporate with specific branch members to have a multiple branches for overcoming the problems discussed above.

SUMMARY OF THE INVENTION

Accordingly, a primary object of the present invention is to provide a decorative tube light with multiple branches having a power line section with a plug, a fuse section, at least one branch member, and a plurality of tube light branches. The fuse section comprises a fuse retained inside in a replaceable or non-replaceable way.

Another object of the present invention is to provide a decorative tube light with multiple branches. Incorporating with at least of one branch member, the fuse section may be connected with a number of tube light branches to become a multiple-branch tube light string assembly. The branch member may be L-shaped, T-shaped, Y-shaped, or multiple output ends. The branch member may be formed with a central through hole for hanging the branch member on supporting articles for decorating in various ways.

To achieve the above objects, in accordance with the present invention, there is provided a decorative tube light comprising a power line section, a fuse section, at least one branch member, and a plurality of tube light branches. The power line section has a first end connected with an electrical plug and a second end. The fuse section has a first end that can be connected to the second end of the power line section and a second end. The branch member has an input end connected to the second end of the fuse section, and at least one output end connected to a tube light branch. Each tube light branch has a first end and a second end. The first end of the tube light branch is connected to the output end of the branch member for receiving electric power conducted from the plug and forming a multiple-branch structure. The second end of the tube light branch may be connected with the first end of the next tube light branch for elongating, or be connected another branch member for forming more branches. Finally, an end cap is mounted onto each tail end of the tube light branches for protecting and waterproofing.

Furthermore, the branch member may be formed with a central through hole for hanging the branch member on a supporting article for decorating in various ways.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
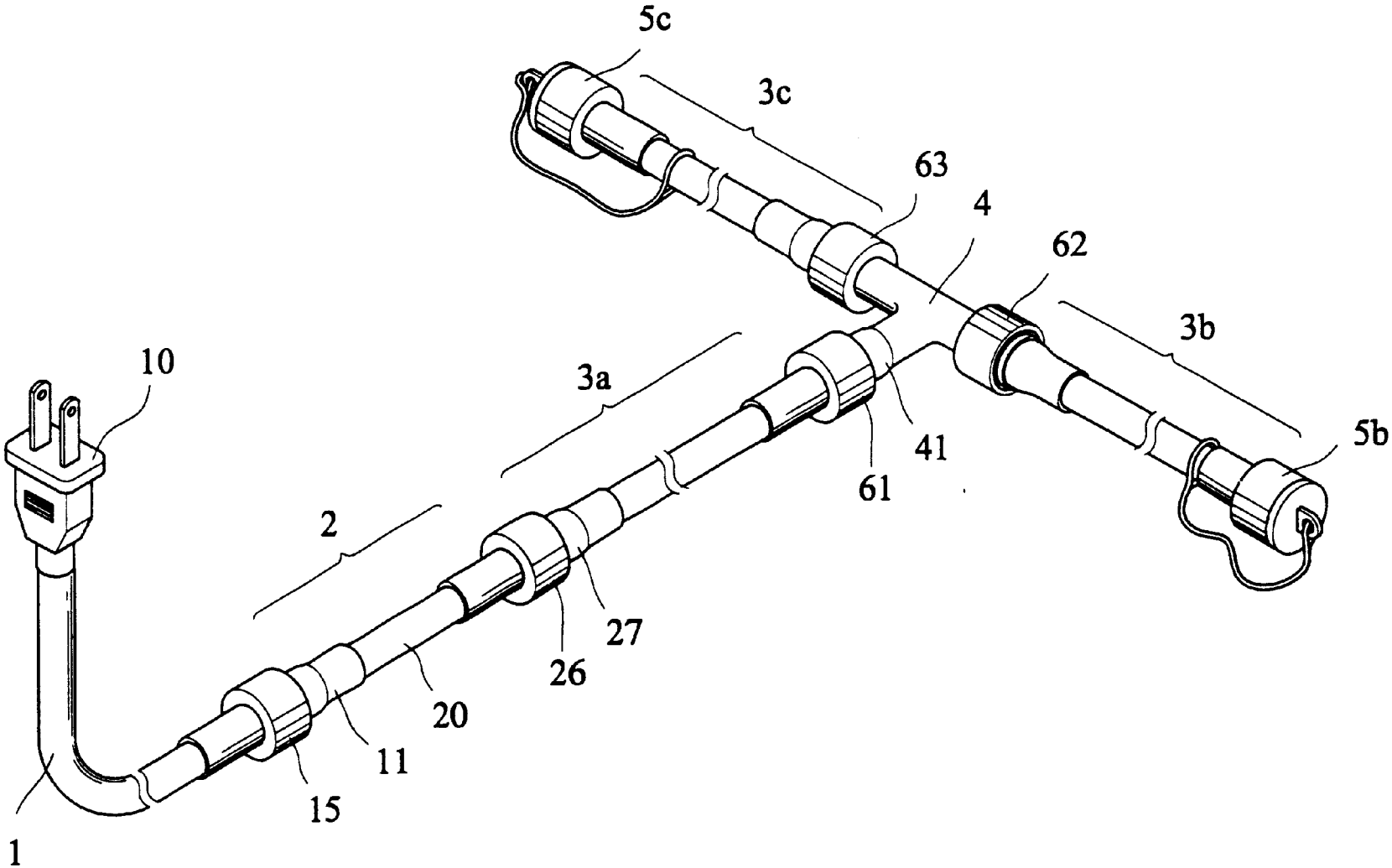
FIG. 1 is a perspective view showing a decorative tube light with multiple branches assembly comprising a branch member and a number of tube light branches constructed in accordance with a preferred embodiment of the present invention.

With reference to the drawings and in particular to FIG. 1, a decorative tube light with multiple branches in accordance with a preferred embodiment of the present invention comprises a power line section 1, a fuse section 2, a plurality of tube light branches 3*a*, 3*b* and 3*c*, a branch member 4, and a plurality of end caps 5*b* and 5*c*. The tube light branches 3*b* and 3*c* are connected to the tube light branch 3*a* via the branch member 4.

The power line section 1 has a first end connected with an electrical plug 10 and a second end 11. A pair of conductive wires 14*a* and 14*b* are spaced from each other and parallelly extended inside the power line section 1 from the electrical plug 10 to the second end 11 for supplying electric power.

The fuse section 2 has a first end 21 that can be connected to the second end 11 of the power line section 1 and a second end 27. A pair of conductive wires 24*a* and 24*b* are also spaced from each other and parallelly extended inside the fuse section 2 and a fuse 25 is connected to one of the connective wires, such as 24*b*, in series.

Each of the tube light branches 3*a*, 3*b* and 3*c* has a first end and a second end. A pair of conductive wires are parallelly extended between the first end and the second end and a plurality of light emitting elements are electrically connected across the conductive wires. The first end of the tube light branch 3*a* is connected to the second end 27 of the fuse section 2 by a coupling ring 26.

The branch member 4 has an input end 41 connected to the second end 27 of the tube light branch 3*a*, and two output ends 42 and 43 connected to tube light branches 3B and 3*c* respectively. Each of the first ends of the tube light branches 3*b* and 3*c* is respectively connected to the output ends 42 and 43 of the branch member 4 for receiving the electric power conducted from the plug 10. The second ends of the tube light branches 3*b* and 3*c* are mounted with an end caps 5*b* and 5*c* respectively for protecting.

Figure 2:
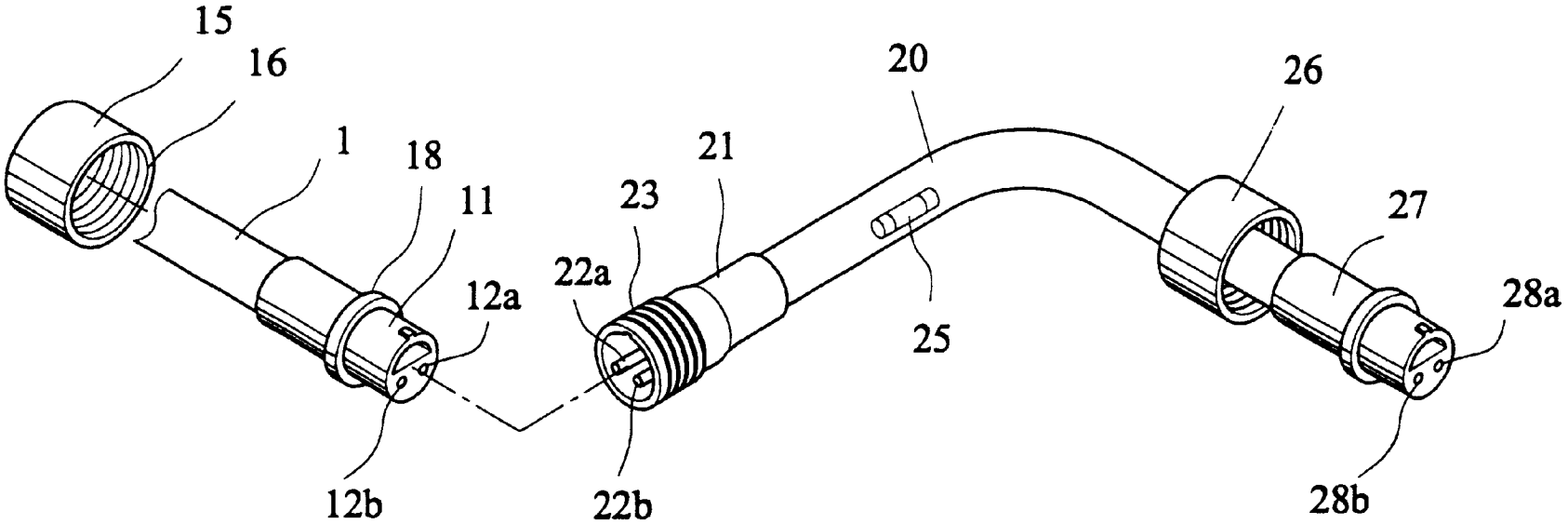
FIG. 2 is a perspective view showing the power line section and the fuse section of FIG. 1 being separated.
Figure 3:
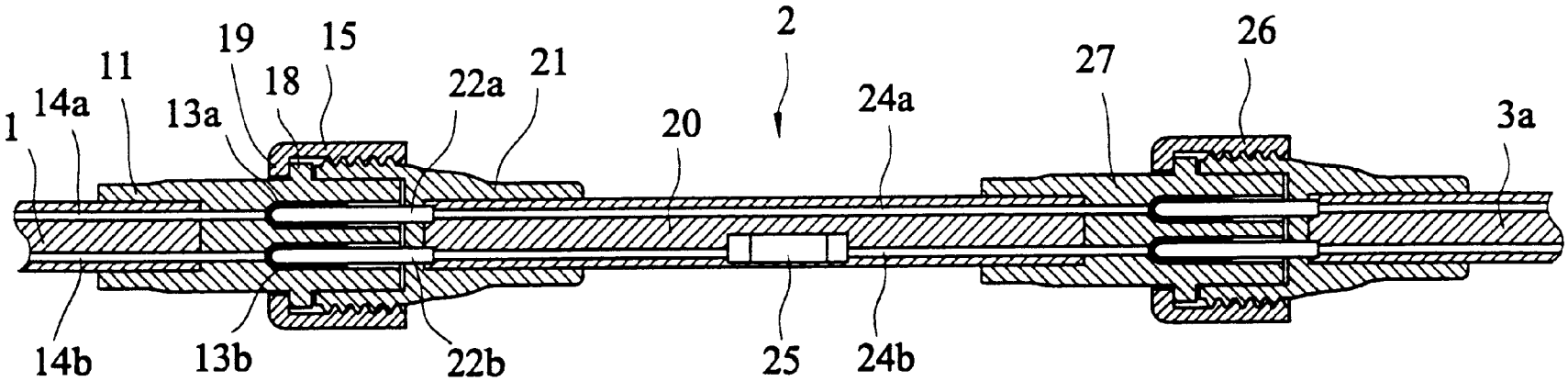
FIG. 3 is a cross-sectional view showing the fuse section being connected between a power line section and an tube light branch in accordance with a preferred embodiment of the present invention.

With reference to FIG. 2 and FIG. 3, a pair of conductive wires 14*a* and 14*b* are spaced from each other and parallelly extended inside the power line section 1 from the electrical plug 10 to the second end 11 for supplying electric power. The second end 11 of the power line section 1 comprises two sockets 12*a* and 12*b* formed thereon. Each of the sockets 12*a* and 12*b* retains a conductive sleeve 13*a* and 13*b* therein and the conductive sleeves 13*a* and 13*b* are electrically connected to the corresponding conductive wires 14*a* and 14*b*.

In accordance with a preffered embodiment of the present invention, the fuse section 2 has a first end 21 that can be connected to the second end 11 of the power line section 1 and a second end 27. A transparent tube 20 is formed between the first end 21 and the second end 27 of the fuse section 2. A pair of conductive wires 24*a* and 24*b* are spaced from each other and parallelly extended inside the transparent tube 20. A fuse 25 is retained in a fuse retaining hole formed in the transparent tube 20 and electrically connected to one of the conductive wires, such as the conductive wire 24*b*, in series.

Corresponding to the structure of the second end 11 of the power line section 1, the first end 21 of the fuse section 2 comprises a pair of conductive rods 22*a* and 22*b* protrusive to an end portion thereof. Each of the conductive rods 22*a* and 22*b* is electrically connected to the corresponding conductive wires 24*a* and 24*b* extending inside the transparent tube 20.

Same to the structure of the second end 11 of the power line section 1, the second end 27 of the fuse section 2 comprises two sockets 28*a* and 28*b* formed thereon. Each of the sockets 28*a* and 28*b* retains a conductive plate therein and the conductive plates are electrically connected to the corresponding conductive wires 24*a* and 24*b*.

When connecting the power line section 1 and the fuse section 2, the conductive rods 22*a* and 22*b* on the first end 21 of the fuse section 2 will be inserted into the sockets 12*a* and 12*b* formed on the second end 11 of the power line section 1. The conductive rods 22*a* and 22*b* will contact with the conductive sleeves 13*a* and 13*b* retained inside the sockets 12*a* and 12*b*, and the electric power will be conducted from the plug 10 to the fuse section 2.

Also referring to FIG. 2 and FIG. 3, the first end 21 of the fuse section 2 is formed with an outer thread 23. A coupling ring 15 formed with an inner thread 16 is used to couple the first end 21 of the fuse section 2 onto the second end 11 of the power line section 1 by screwing the coupling ring 15 onto the first end 21 of the fuse section 2. An inward rib 17 is formed at one end of the coupling ring 15 and a stop rib 18 is formed on the second end 11 of the power line section 1. When the coupling ring 15 is screwed onto the first end 21 of the fuse section 2, the coupling ring 15 may be limited by the stop rib 18 for firmly locking the power line section 1 and the fuse section 2 preventing from fall off. The same structure is also formed on the second end 27 of the fuse section 2, the output ends of the branch member 4, and the second ends of the tube light branches 3*a*, 3*b* and 3*c*.

Figure 4:
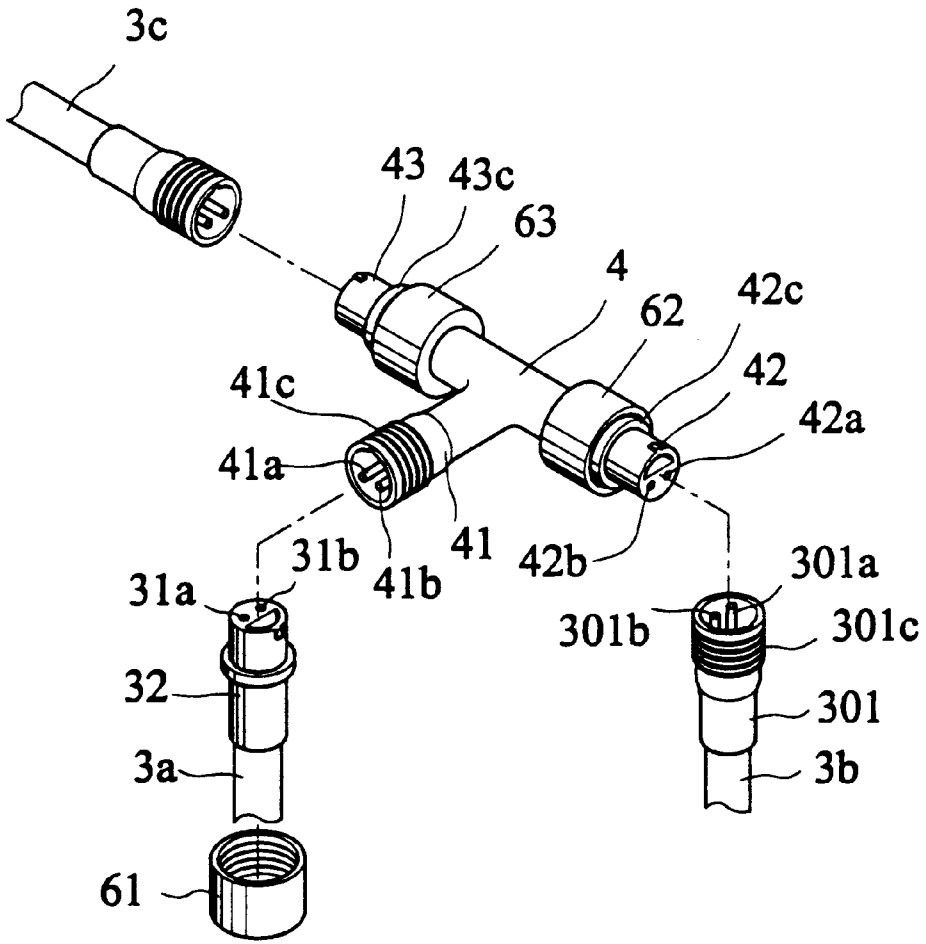
FIG. 4 is a perspective view showing a T-shaped branch member and the tube light branches of FIG. 1 being separated.
Figure 5:
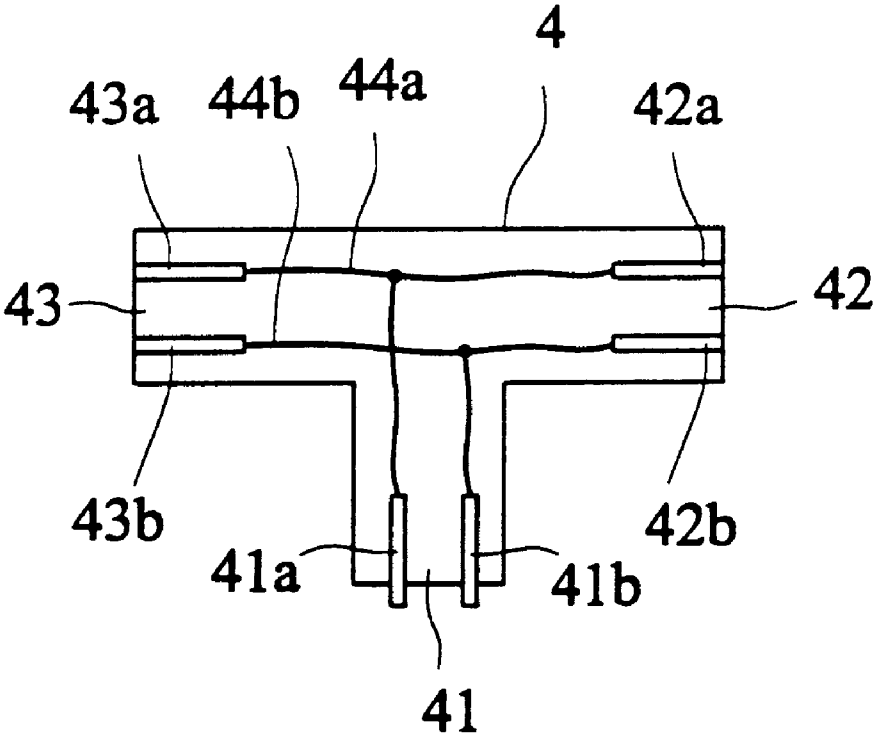
FIG. 5 is a schematic diagram showing a circuit connection in the branch member shown in FIG. 4.

With accordance to FIG. 4 and FIG. 5, the branch member 4 comprises an input end 41 removeably connected to the second end 32 of the tube light branch 3*a* and two output ends 42 and 43. A pair of conductive wires 44*a* and 44*b* are spaced from each other and extending from the input end 41 to both output ends 42 and 43. The first output end 42 comprises two sockets 42*a* and 42*b* formed thereon. Each of the socks 42*a* and 42*b* retains a conductive sleeve therein and the conductive sleeves are electrically connected to the corresponding ends of the conductive wires 44*a* and 44*b*. The second output end 43 also comprises two sockets 43*a* and 43*b* formed thereon. Each of the sockets 43*a* and 43*b* retains a conductive sleeve therein and the conductive sleeves are electrically connected to the corresponding ends of the conductive wires 44*a* and 44*b*.

The input end 41 of the branch member 4 comprises a pair of conductive rods 41*a* and 41*b* protrusive to an end portion thereof. Each of the conductive rods 41*a* and 41*b* is electrically connected to the conductive wires 44*a* and 44*b* respectively.

The same as the fuse section 2, each of the tube light branches 3*a*, 3*b* and 3*c* has a pair of conductive rods formed on its first end and the conductive rods are protrusive to an end portion thereof. Two sockets are formed on the second end of each extending tube light. Each of the sockets retains a conductive plate therein and the conductive plates are electrically connected to the corresponding conductive wires extending inside each extending tube light.

When connecting the branch member 4 with the tube light branches 3*a*, 3*b* and 3*c*, the conductive rods 41*a* and 41*b* on the input end 41 of the branch member 4 will be inserted into the sockets 31*a* and 31*b* respectively formed on the second end 32 of the tube light branch 3*a*. The conductive rods 41*a* and 41*b* will contact with the conductive sleeves retained inside the sockets 31*a* and 31*b*. Incorporating with a coupling ring 61, the input end 41 of the branch member 4 and the second end 32 of the tube light branch 3*a* will be firmly locked.

Figure 6:
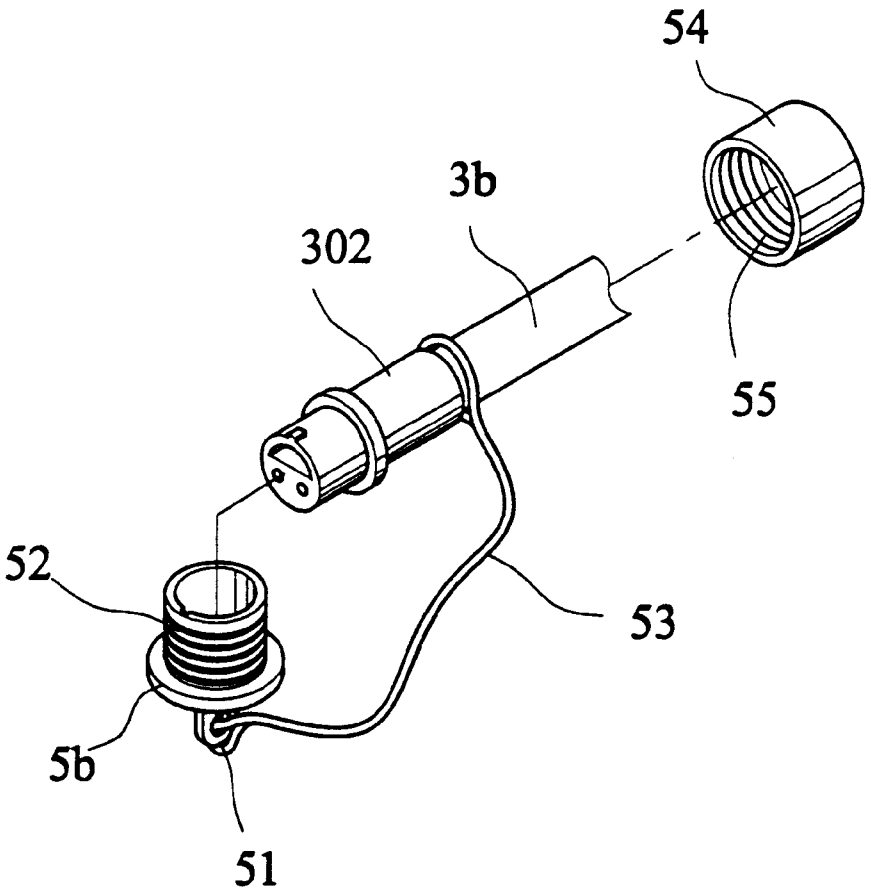
FIG. 6 is an exploded view of the end cap in accordance with a preferred embodiment of the present invention.

With reference to FIG. 6, the end cap such as 5*b* comprises a protrusive portion having a horizontal through hole 51 formed thereon. A mooring rope 53 is fastened between the horizontal through hole 51 of the end cap 5*b* and the tail end 302 of the tube light 3*b* for preventing from the end cap

5*b* losing. The end cup 5*b* is also formed with an outer thread 52. The end cap 5*b* may be locked on the tail end 302 of the extending tube light 3*b* by a coupling ring 54 provided with an inner thread 55.

Figure 7:
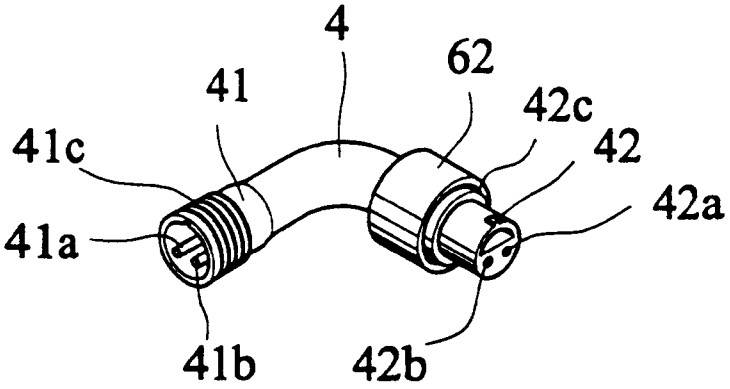
FIG. 7 is a perspective view of the L-shaped branch member in accordance with a preferred embodiment of the present invention.

The branch member 4 in accordance with the present invention may be in various forms. FIG. 7 is a perspective view of the branch member which is in a form of L-shaped structure. In this embodiment, the branch member 4 has an input end 41 adapted to be connected onto the second end of the tube light branch. The input end 41 also includes a pair of conductive rods 41*a* and 41*b*, and an outer thread 41*c*. The conductive rods 41*a* and 41*b* is protrusive to an end portion thereof and electrically connected to the conductive wires arranged in the branch member 4 respectively. The output end 42 comprises two sockets 42*a* and 42*b* formed thereon. Each of the socks 42*a* and 42*b* retains a conductive sleeve therein and are electrically connected to the corresponding conductive wires arranged in the branch member 4. The output end 42 is also provided with a stop rib 42*c* for a coupling ring 62.

Figure 8:
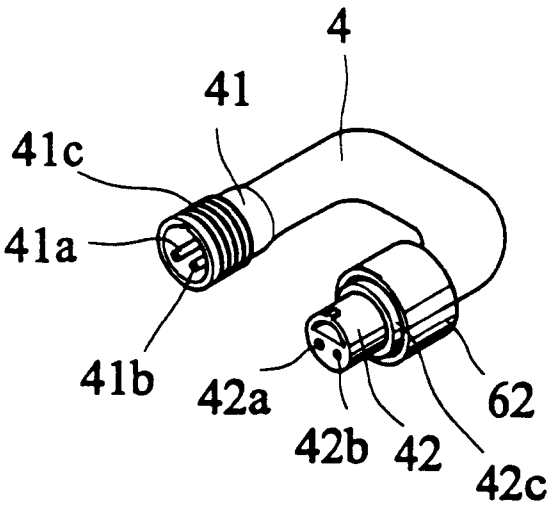
FIG. 8 is a perspective view of the U-shaped branch member in accordance with a preferred embodiment of the present invention.

FIG. 8 is a perspective view of the branch member which is in a form of U-shaped structure according to another embodiment of the present invention. The structure of the branch member in this embodiment is similar to that of the branch member 4 shown in FIG. 7. The input end 41 of the branch member 4 is also provided with a pair of conductive rods 41*a* and 41*b*, and an outer thread 41*c*. The output end 42 of the branch member 4 is also provided with two sockets 42*a*, 42*b*, a stop rib 42*c*, a coupling ring 62.

Figure 10:
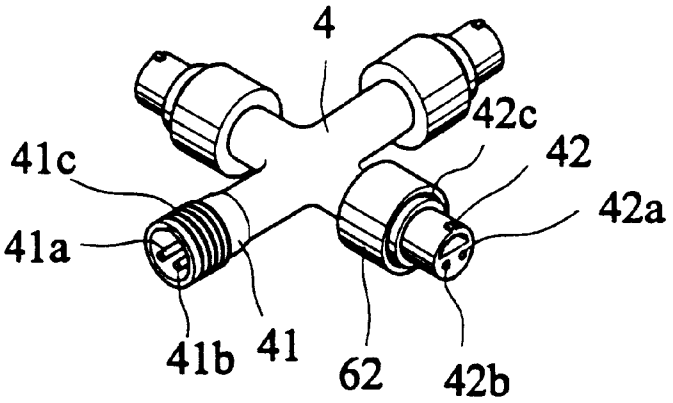
FIG. 10 is a perspective view of the branch member having one input end and three output ends in accordance with a preferred embodiment of the present invention.
Figure 9:
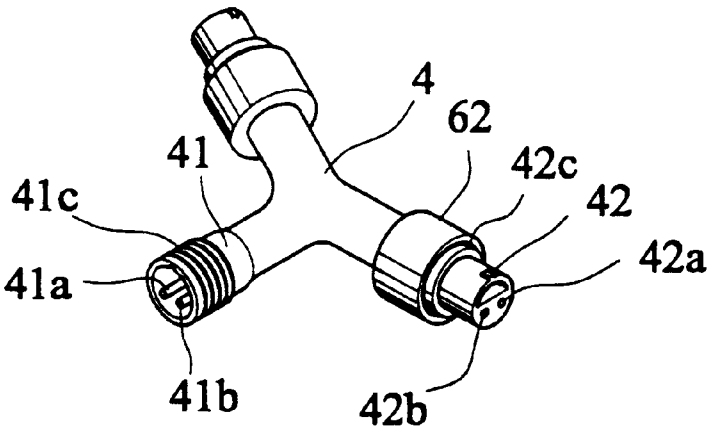
FIG. 9 is a perspective view of the Y-shaped branch member in accordance with a preferred embodiment of the present invention.
Figure 11:
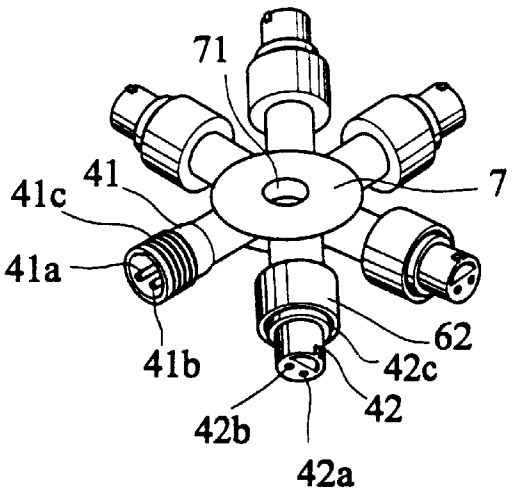
FIG. 11 is a perspective view of the branch member having one input end and five output ends in accordance with a preferred embodiment of the present invention.

It is to be understood that the branch member of the present invention may include an input end and a number of output ends with similar structure as mentioned in the previous embodiments. For example, FIG. 10 is a perspective view of the branch member having one input end 41 and three output ends 42. FIG. 11 is a perspective view of the branch member 4 having one input end 41 and five output ends 42. It is noted that the branch member 4 is further provided with a central through hole 71 in the central body 7 thereof.

Figure 12:
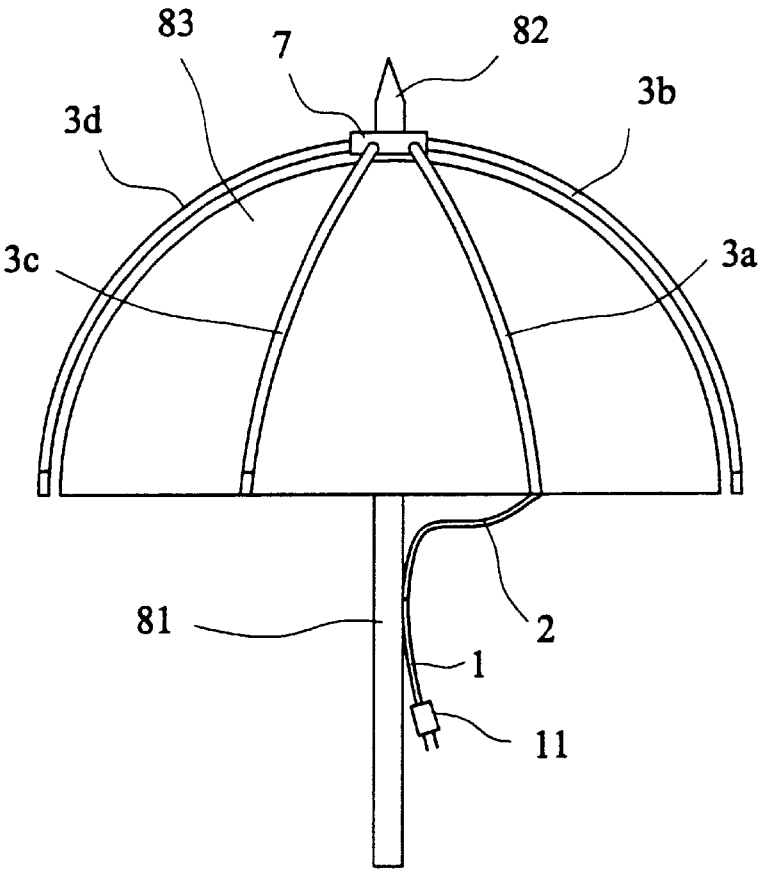
FIG. 12 is a perspective view showing a decorative tube light with multiple branches being arranged on an umbrella.

FIG. 12 is a perspective view showing a decorative tube light with multiple branches being arranged on a supporting article, such as an umbrella. The branch member 4 as shown in FIG. 11 is particularly adapted to be hanged on a central tip 82 extended from a central post 81, so that the light branches 3*a*, 3*b*, 3*c*, and 3*d* are supported on the top surface 83 of the supporting article and angularly spaced from each other about the central post 81.

Although the present invention has been described with respect to the preferred embodiments, it is contemplated that a variety of modifications, variations and substitutions may be done without departing from the scope of the present invention that is intended to be defined by the appended claims.

What is claimed is:

1. A decorative tube light assembly with multiple branches, comprising:

a power line section having a first end connected with an electrical plug and a second end, and a pair of conductive wires spaced from each other and extending in parallel to each other in the power line section from the first end to the second end thereof, the second end of the power line section having two sockets formed thereon, each of the sockets retaining a conductive sleeve therein, each conductive sleeve being electrically connected to one of the conductive wires extending in the power line section;

at least one branch member having an input end removably connected to the second end of the power line section and a plurality of output ends, a pair of conductive wires being spaced from each other and extending from the input end to each output end; and a plurality of tube light branches, each of the tube light branches having a first end removably connected to one of the output ends of the branch member and a second end mounted with an end cap, each of the tube light branches comprising a pair of conductive wires spaced from each other and extending in parallel to each other from the first end of the second end thereof and a plurality of light emitting elements electrically connected between the conductive wires, thereby forming a tube light string with multiple tube light branches.

2. The decorative tube light string with multiple branches as claimed in claim 1, further comprising a fuse section having a first end removably connected to the second end of the power line section and a second end removably connected to the input end of the branch member, the fuse section having a pair of conductive wires spaced from each other and extending in parallel to each other in the fuse section from the first end to the second end thereof, at least one of the conductive wires being further electrically connected with a fuse in series.

3. The decorative tube light string with multiple branches as claimed in claim 1, wherein the tube light branches are made of transparent material.

4. The decorative tube light string with multiple branches as claimed in claim 1, wherein the input end of the branch member is formed with an outer thread, a coupling ring formed with an inner thread being used to couple the input end of the branch member onto the second end of the power line section by screwing the coupling ring onto the first end of the fuse section.

5. The decorative tube light string with multiple branches as claimed in claim 4, wherein the coupling ring is further formed with an inward ring at one end thereof and the second end of the power line section is formed with a stop rib, thus the coupling ring is limited by the stop rib when the coupling ring is screwed onto the first end of the fuse section.

6. The decorative tube light string with multiple branches as claimed in claim 1, wherein the input end of each tube light branch is formed with an outer thread, a coupling ring formed with an inner thread being used to couple the first end of the tube light branch onto the output end of the branch member by screwing the coupling ring onto the first end of the tube light branch.

7. The decorative tube light string with multiple branches as claimed in claim 6, wherein the coupling ring is further formed with an inward ring at one end thereof and each of the output ends of the branch member is formed with a stop rib, thus the coupling ring is limited by the stop rib when the coupling ring is screwed onto the first end of the tube light branch.

8. The decorative tube light string with multiple branches as claimed in claim 1, each of the tube light branches further comprising a plurality of tube light strings connected in series.

9. The decorative tube light string with multiple branches as claimed in claim 1, wherein the branch member is provided with one input end connected onto the second end of the power line section and two output ends each of which is connected to a tube light branch.

10. The decorative tube light string with multiple branches as claimed in claim 9, wherein the branch member is in a form of Y-shaped structure.

11. The decorative tube light string with multiple branches as claimed in claim 9, wherein the branch member is in a form of T-shaped structure.

12. The decorative tube light string with multiple branches as claimed in claim 1, wherein the branch member is provided with one input end connected onto the second end of the power line section and three output ends each of which is connected to a tube light branch.

13. The decorative tube light string with multiple branches as claimed in claim 1, wherein the branch member is provided with one input end connected onto the second end of the power line section and five output ends each of which is connected to a tube light branch.

14. The decorative tube light string with multiple branches as claimed in claim 1, wherein the branch member is provided with a central through hole.

15. A decorative tube light assembly with multiple branches, comprising:

a power line section having a first end connected with an electrical plug and a second end, provided with a pair of conductive wires spaced from each other and extending parallel to each other in the power line section from the first end to the second end thereof;

a supporting article having a central post, a top surface supported on the central post, and a central tip extended from the central post;

a branch member having an input end removably connected to the second end of the power line section and a plurality of output ends, a pair of conductive wires being spaced from each other and extending from the input end to each output end, the branch member being further provided with a central through hole; and a plurality of tube light branches, each of the tube light branches having a first end removably connected to one of the output ends of the branch member and a second end mounted with an end cap, each the tube light branches comprising a pair of conductive wires spaced from each other and extending in parallel to each other from the first end to the second end thereof and a plurality of light emitting elements electrically connected between the conductive wires, thereby forming a tube light string with multiple tube light branches;

wherein the central through hole of the branch member is hanged on the central tip of the central post and the light branches connected to the output ends of the branch member are supported on the top surface of the supporting article and angularly spaced from each other about the central post.

16. The decorative tube light string with multiple branches as claimed in claim 15, wherein the tube light branches are made of transparent material.

17. The decorative tube light string with multiple branches as claimed in claim 15, wherein the supporting article is an umbrella.

18. A decorative tube light assembly, comprising:

a power line section having a first end connected with an electrical plug and a second end, and a pair of conductive wires spaced from each other and extending in parallel to each other in the power line section from the first end to the second end thereof;

at least one branch member having an input end removably connected to the second end of the power line section and at least one output end, a pair of conductive wires being spaced from each other and extending from the input end to each output end, wherein the branch member is a U-shaped structure having an input end connected onto the second end of the power line section and an output end; and at least one tube light branch, the tube light branch having a first end removably connected to one of the output end of the branch member and a second end mounted with an end cap, the tube light branch comprising a pair of conductive wires spaced from each other and extending in parallel to each other from the first end of the second end thereof and a plurality of light emitting elements electrically connected between the conductive wires, thereby forming a decorative tube light string.

* * * * *